United States Patent [19]

Debaigt

[11] 4,175,822

[45] Nov. 27, 1979

[54] AXIAL CONNECTION TERMINAL

[75] Inventor: Jean Debaigt, Maisons Laffitte, France

[73] Assignee: CGEE Alsthom, Levallois Perret, France

[21] Appl. No.: 950,348

[22] Filed: Oct. 11, 1978

[30] Foreign Application Priority Data

Oct. 26, 1977 [FR] France ..... 77 322541

[51] Int. Cl.[2] ..... H01R 9/10

[52] U.S. Cl. ..... 339/266 R

[58] Field of Search ..... 339/266, 270, 274

[56] References Cited

U.S. PATENT DOCUMENTS

| | | | |
|---|---|---|---|
| 2,451,466 | 10/1948 | Bentley | 339/266 R |
| 3,812,453 | 5/1974 | Kiessling | 339/266 R |
| 4,077,696 | 3/1978 | Glaesel | 339/266 R |

*Primary Examiner*—Joseph H. McGlynn

*Attorney, Agent, or Firm*—Sughrue, Rothwell, Mion, Zinn and Macpeak

[57] ABSTRACT

The terminal is mounted in a block of insulating material (1). Its purpose is to connect an axially inserted end of a conductor wire (6) to some other electrical circuit (not shown) via a connection strip (4). The connection strip includes a bent down tongue which passes through a wire-clamping cage (3). The cage pivots on shoulders (43) near the end (45) of the tongue. A screw (5) passes through the main portion of the connection strip and engages a flap (36) of the cage. The arrangement is such that tightening the screw rocks the cage so that a corner (38) at its end opposite to the screw wedges a previously inserted wire against the tongue of the connection strip. This arrangement uses a single component, the wire clamping cage, to perform a function that previously required a first component such as a lever or wedge to engage a second component such as a wire-receiving clip.

8 Claims, 5 Drawing Figures

AXIAL CONNECTION TERMINAL

FIELD OF THE INVENTION

The invention relates to an axial connection terminal for a conductor, in particular for electrical terminal blocks.

BACKGROUND OF THE INVENTION

In such a terminal, the conductor is generally clamped against a connection strip by means of a clamping screw which is integral with a clamp and which presses against a moving intermediate part which forms a lever or a wedge. A device constituting such a connection uses three pieces in addition to the connection strip: a clip, a screw and an intermediate part.

The invention aims to provide an axial connection terminal which uses only two pieces in addition to the connection strip and which can consequently be manufactured at a more competitive price.

SUMMARY OF THE INVENTION

The invention provides an axial connection terminal for receiving an electrical conductor wire, the terminal being mounted on or in an insulating support and comprises a screw.

A connection strip includes a body portion, and an end portion in the form of a tongue is disposed substantially at right angles to the body portion. The portion includes a bore for receiving the screw so that the screw can pass through the body portion substantially in parallel with the tongue.

A wire-clamping cage is disposed around the tongue and is pivoted to rock on a shoulder of the tongue in a plane generally defined by said portions of the connection strip. One end of the wire-clamping cage is arranged to engage the screw and the other end of the cage defines a wire-receiving opening between itself and the tongue for axially receiving an electrical conductor wire. The arrangement is such that, in operation, as the screw extends progressively further through the body portion of the connection strip it engages the wire-clamping cage and pivots it on the shoulder so that the wire-receiving opening closes progressively whereby a wire received in the opening is clamped against the tongue by the said other end of the wire-clamping cage.

An embodiment of the invention is described by way of example with reference to the accompanying drawings.

Figure 1:
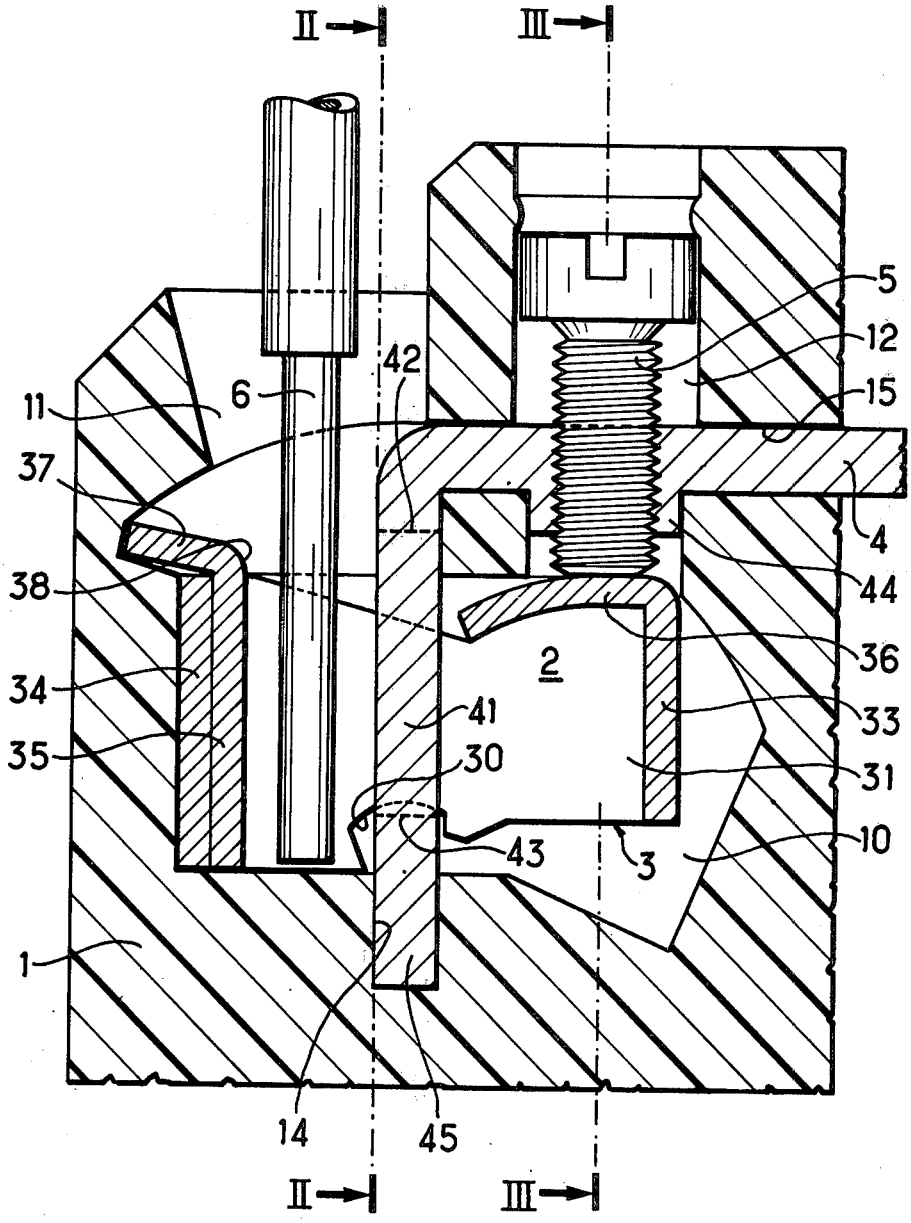
FIG. 1 is a partial cross-sectional view of an electrical terminal block fitted with a connection terminal in accordance with the invention, the terminal being in the loose position.
Figure 2:
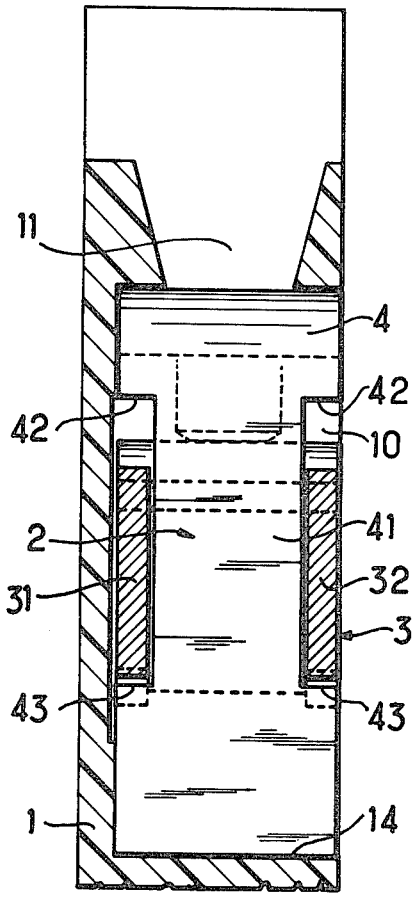
FIG. 2 is a cross-section view along II—II in FIG. 1.
Figure 3:
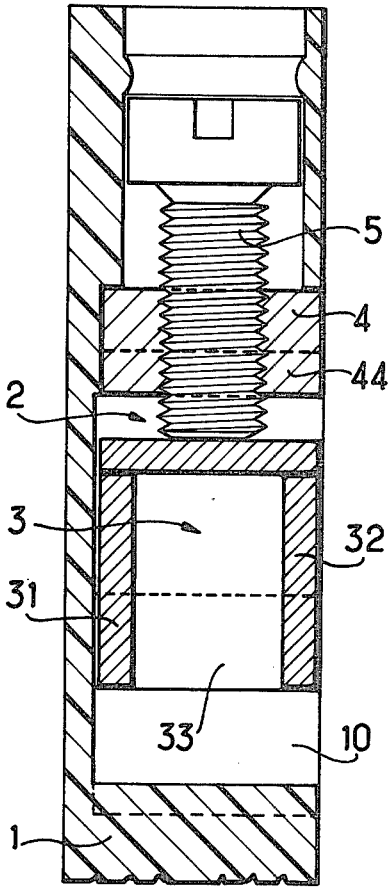
FIG. 3 is a cross-section view along III—III in FIG. 1.

In the figures, 1 designates part of an insulating support of an electrical terminal block and 2 designates generally a connection terminal assembly disposed in recesses 10, 12, 13, 14 and 15 inside the insulating support 1.

The terminal 2 comprises a wire-clamping cage indicated generally at 3, a connection strip 4 and a clamping screw 5.

Figure 4:
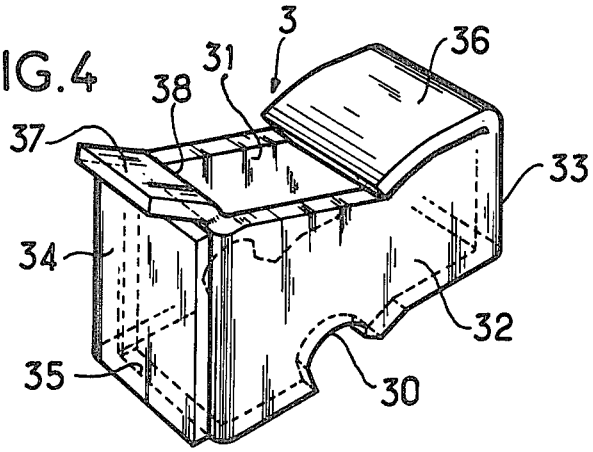
FIG. 4 is a perspective view of a connector cage of the terminal.

The wire-clamping cage 3 is made of metal sheet folded into a shape reminiscent somewhat, of a rectangular shoe upper, lacking a sole. It has two side walls 31 and 32, a first, or "toe" end wall 33 and opposite thereto it has two overlapping portions 34 and 35 constituting a second, or "heel" end wall. The overlapping end wall portions 34 and 35 are continuations of the side walls 31 and 32 respectively, FIG. 4.

A flap 36 extends from the upper edge of the "toe" end wall 33 and curves over the side walls 31 and 32 to form a rounded "toe cap". The flap 36 extends about half way along the upper edges of the side walls 31 and 32 to leave a conductor-receiving opening in a position analogous to the leg-receiving opening of a shoe.

A conductor-guiding tab 37 extends from the upper edge of the inner one 35 of the end wall portions 34 and 35 at the "heel" end of the cage 3. This tab 37 is turned outwards and serves to guide a conductor into the cage 3 in a manner analogous to a shoe-horn guiding a foot into a shoe.

The side walls 31 and 32 each have a notch 30 near the middle of their lower edges. These notches are for receiving shoulders 43 of the connection strip 4 on which the cage 3 rocks, in operation, under the effect of the clamping screw 5.

The end of the connection strip 4 which is designed to connect the terminal 2 to another terminal, not shown, has a folded-down tongue 41 which includes a portion narrower than the body of the connection strip. The tongue 41 passes through the cage 3 and the narrower portion is delimited at its upper end by shoulders 42 and at its lower end 45 by the shoulders 43. The body of the connection strip has a protruding collar 44 with a tapped hole for receiving the screw 5.

The terminal operates as follows. The end part 45 of the connection strip 4 is inserted through the top of wire-clamping cage 3 so as to thread the tongue 41 between the side walls 31 and 32, with the protruding screw-receiving collar 44 of the strip 4 disposed above the flap 36. Then the assembly thus formed is inserted so as to fix the connection strip in the insulating support 1, the end part 45 is fixed in a vertical lower recess 14 of the support 1 and the body is fixed in a horizontal upper recess 15. The notches 30 of the wire-clamping cage 3 are pressed against the lower shoulders 43, the wire clamping cage is capable of rocking in the central recess 10 with the notches 30 sliding against the shoulders 43.

The screw 5 is then inserted in a cylindrical cavity which constitutes the recess 12 and in the tapped hole of the protruding collar 44. The diameter of the cavity 12 is the same as that of the head of the screw 5 and includes a ridge to hold the screw captive when the terminal is not in use.

To connect the terminal to a conductor, the conductor wire is inserted through an upper recess 11 of the insulating support 1, which recess communicates with the central recess 10, so as to insert the wire between the tongue 41 and the second on "heel" end wall 34/35, as shown in FIG. 1, this is facilitated by the conductor-guiding tab 37.

Figure 5:
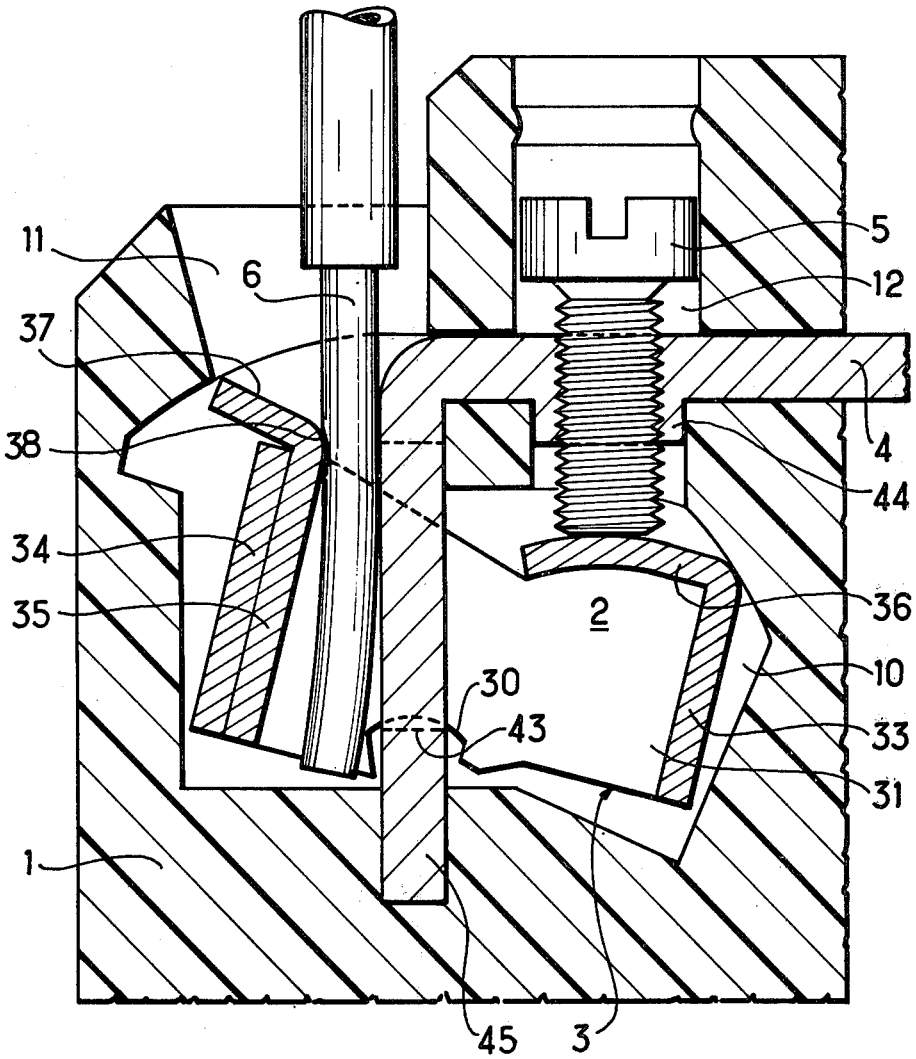
FIG. 5 is an identical view to that in FIG. 1 with the terminal in the clamping position.

The screw 5 is then driven through the tapped hole of the protruding collar 44; its end modifies the convexity of the flap 36 of the wire-clamping cage 3, while the screw head is guided along the cylindrical recess 12. The wire-clamping cage 3 then tilts in the central recess 10 to reach the position shown in FIG. 5, the notches 30 rock on the stationary shoulders 43. In the tilting movement, the "heel" end wall 35 approaches the tongue 41 against which it clamps a conductor wire 6. The bend 38 at the base of the tab 37 where it meets the wall 35 then forms a wedge for clamping the conductor wire against the tongue 41 of the connection strip. This traps the conductor wire.

In addition to the connection strip, such a terminal uses only two parts: a wire-clamping cage and a screw. It is easy to manufacture at a competitive price.

I claim:

1. An axial connection terminal for receiving a conductor wire, said connection terminal comprising: firstly a wire-clamping cage, said cage comprising a metal sheet folded in the form of a sleeve of rectangular cross-section formed by two opposite end walls and by two opposite side walls, a first end wall which includes at its upper edge a first rounded extension with a concave part turned inwards against the upper edges of the side walls, said side walls including respectively notches at the center of their lower edges; and secondly a connection strip having at one end a folded-down portion, said folded down portion having an end portion widened and limited by shoulders, said folded down portion being disposed between the side walls of the wire-clamping cage and each shoulder being disposed to press against one of the notches, a clamping screw threaded through said connection strip and bearing on said first rounded extension, said notches pivoting against said shoulders by the action of the end of said clamping screw which bears against said first extension, and said conductor wire being clamped between the second end wall and the folded portion of the connection strip.

2. A terminal according to claim 1, wherein the upper part of the second end wall includes a second extension folded outwards and forming an input guide for the wire.

3. A terminal according to claim 1, wherein the connection strip (4) has a protruding collar (44) with a threaded hole to receive the screw (5).

4. A terminal according to claim 1, wherein the edges of the folded-down portion (41) include a notch limited by lower shoulders (43) and upper shoulders (42).

5. A terminal according to claim 1, wherein the second end wall is double and is formed by extensions (34, 35) of the adjacent side walls (31, 32).

6. In combination, a terminal block, an axial connection terminal for receiving a conductor wire, said terminal block comprising an insulating support having a recess therein, said connection terminal being received within said insulating support recess and being fixed thereto, said connection terminal comprising: firstly, a wire-clamping cage, said cage comprising a metal sheath folded in the form of a sleeve of rectangular cross-section formed by two opposite end walls and by two opposite side walls, a first end wall which includes at its upper edge a first rounded extension with a concave part turned inwards against the upper edges of said side walls, said side walls including, respectively, notches at the center of their lower edges; and secondly, a connection strip having at one end a folded down portion and said folded down portion having an end portion widened and limited by shoulders, said folded down portion being disposed between the side walls of the wire-clamping cage and each shoulder being disposed to press against one of the notches, a clamping screw threaded through said connection strip and being on said first rounded extension, said notches pivoting against said shoulders by the action of the end of the clamping screw which bears against said first extension and said conductor wire being clamped between the second end wall and the folded portion of the connection strip.

7. A terminal according to claim 6, wherein the connection strip (4) is fixed to the insulating support (1).

8. A terminal according to claim 7, wherein the clamping screw is disposed in a recess constituted by a cylindrical cavity in the insulating support to guide it.

* * * * *